US010612854B2

(12) United States Patent
Chu et al.

(10) Patent No.: US 10,612,854 B2
(45) Date of Patent: Apr. 7, 2020

(54) SAMPLE HOLDER ANNEALING APPARATUS USING THE SAME

(71) Applicant: Industrial Technology Research Institute, Hsinchu (TW)

(72) Inventors: Hsu-Shen Chu, Hsinchu (TW); Chien-Neng Liao, Taichung (TW); Yao-Hsiang Chen, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 1253 days.

(21) Appl. No.: 14/547,152

(22) Filed: Nov. 19, 2014

(65) Prior Publication Data

US 2015/0176904 A1 Jun. 25, 2015

(30) Foreign Application Priority Data

Dec. 25, 2013 (TW) ..... 102148226 A

(51) Int. Cl.
*F27D 21/00* (2006.01)
*C21D 1/40* (2006.01)
(Continued)

(52) U.S. Cl.
CPC ..... *F27D 21/0014* (2013.01); *C21D 1/40* (2013.01); *C21D 9/0025* (2013.01); *F27B 17/02* (2013.01);
(Continued)

(58) Field of Classification Search
CPC .... F27D 21/0014; F27D 5/0006; F27D 19/00; C21D 1/40; C21D 9/0025; C21D 2201/03; F27B 17/02; H05B 3/0004
(Continued)

(56) References Cited

U.S. PATENT DOCUMENTS 5,935,292 A 8/1999 Hernandez et al.
5,968,394 A 10/1999 Schob
(Continued)

FOREIGN PATENT DOCUMENTS

CN 1547757 11/2004
CN 101082817 12/2007
(Continued)

OTHER PUBLICATIONS

"Office Action of China Counterpart Application," dated May 3, 2017, p. 1-p. 10.
(Continued)

*Primary Examiner* — Dana Ross
*Assistant Examiner* — Joseph M Baillargeon
(74) *Attorney, Agent, or Firm* — JCIPRNET

(57) ABSTRACT

A sample holder for annealing apparatus and electrically assisted annealing apparatus using the same are provided. The sample holder includes a heat conductive shell, high thermal conductive and electrical insulation blocks, first and second electrodes. The heat conductive shell includes a base frame and a top cover. The high thermal conductive and electrical insulation blocks are adjacent to the base frame and the top cover, respectively, and a sample pallet is sandwiched therebetween. Length and width of the sample pallet is smaller than that of the high thermal conductive and electrical insulation blocks. The first and the second electrodes are fixed to two sides of the sample pallet, and are connected to electrifying wire respectively. Thickness of the first and the second electrodes is smaller than that of the sample pallet, while the width of the first and the second electrodes is longer than that of the sample pallet.

12 Claims, 11 Drawing Sheets

(51) Int. Cl.

| | |
|---|---|
| ***C21D 9/00*** | (2006.01) |
| ***F27B 17/02*** | (2006.01) |
| ***F27D 5/00*** | (2006.01) |
| ***F27D 19/00*** | (2006.01) |

(52) U.S. Cl.
CPC ..... *F27D 5/0006* (2013.01); *F27D 19/00* (2013.01); *C21D 2201/03* (2013.01)

(58) Field of Classification Search
USPC ... 219/68, 50, 383, 388, 538, 541, 770, 780; 422/550, 125, 285, 307; 266/262; 435/91.2, 289.1
See application file for complete search history.

(56) References Cited

U.S. PATENT DOCUMENTS

| | | | | |
|---|---|---|---|---|
| 6,911,717 | B2 | 6/2005 | Jyumonji | |
| 7,723,649 | B2 | 5/2010 | Guiver | |
| 9,614,257 | B2 * | 4/2017 | Teramoto | H01M 10/48 |
| 2008/0190475 | A1 | 8/2008 | Kita | |
| 2008/0202575 | A1 | 8/2008 | Ren et al. | |
| 2011/0147352 | A1 | 6/2011 | Harte et al. | |
| 2011/0265919 | A1 | 11/2011 | Nakajima | |
| 2012/0193071 | A1 | 8/2012 | Koji et al. | |
| 2013/0269739 | A1 | 10/2013 | Hwang et al. | |
| 2014/0073013 | A1 * | 3/2014 | Gorman | B01L 7/52 435/91.2 |
| 2015/0168014 | A1 * | 6/2015 | Wu | H05B 3/24 219/202 |

FOREIGN PATENT DOCUMENTS

| | | |
|---|---|---|
| CN | 201265027 | 7/2009 |
| CN | 201459185 | 5/2010 |
| TW | 200406033 | 4/2004 |
| TW | 201112463 | 4/2011 |

OTHER PUBLICATIONS

"Notice of Allowance of Taiwan Counterpart Application", dated Sep. 22, 2015, p. 1-p. 3.
Liao et al., "Electrical and thermal transport properties of electrically stressed Bi—Sb—Te nanocrystalline thin films," Thin Solid Films, Mar. 2011, pp. 4394-4399.
Liao et al., "Thermoelectric properties of electrically stressed Sb/Bi—Sb—Te multilayered films," Journal of Applied Physics, Mar. 2010, pp. 066103-1-066103-3.
Liao et al., "Enhancement of thermoelectric properties of sputtered Bi—Sb—Te thin films by electric current stressing," Applied Physics Letters, Jul. 2008, pp. 04203-1-04203-3.

* cited by examiner

SAMPLE HOLDER ANNEALING APPARATUS USING THE SAME

CROSS-REFERENCE TO RELATED APPLICATION

This application claims the priority benefit of Taiwan application serial no. 102148226, filed on Dec. 25, 2013. The entirety of the above-mentioned patent application is hereby incorporated by reference herein and made a part of this specification.

BACKGROUND

Technical Field

The disclosure relates to a sample holder for annealing apparatus and an electrically assisted annealing apparatus using the same.

Related Art

Thermoelectric material is capable of converting electric energy and thermal energy through a Seebeck effect or a Peltier effect. Since the thermoelectric material is a solid state material, and a thermoelectric module using the thermoelectric material has no moving part, the thermoelectric module has advantages of high reliability, long service life and no noise, etc. Performance of the thermoelectric module relates to a thermoelectric material characteristic, hot and cold end temperature ($T_{hot}$ and $T_{cold}$) of the module and temperature difference ($\Delta T$), where the thermoelectric material characteristic is represented by a figure of merit (ZT) value. The ZT value mainly relates to a Seebeck coefficient, electrical conductivity and a thermal conductivity, and the above three parameters also directly determine whether the material has a good thermoelectric property. The higher the ZT value is, the more obvious the thermoelectric effect is, and a relationship thereof is:

$$ZT = \frac{\alpha^2\sigma}{k}T$$

Where, $\alpha$ is the Seebeck coefficient, $\sigma$ is the electrical conductivity, k is the thermal conductivity, and T is the absolute temperature.

Recent studies show that microstructures (for example, nanocrystalline and precipitated phases, etc.) may increase the ZT value of the thermoelectric material. Suitable annealing step ensures nanophase precipitation of the nanocrystalline of the thermoelectric material after hot-pressing consolidation, and eliminates lattice defects, etc., so as to achieve ideal nanoscale microstructures and thermoelectric characteristic.

SUMMARY

An embodiment of the disclosure provides a sample holder for annealing apparatus including a heat conductive shell, high thermal conductive and electrical insulation blocks, a first electrode and a second electrode. The heat conductive shell includes a base frame and a top cover. The high thermal conductive and electrical insulation blocks are respectively disposed adjacent to the top of the base frame and the bottom of the top cover, and a sample pallet is sandwiched between the high thermal conductive and electrical insulation blocks. The first electrode and the second electrode are disposed opposite to each other between the high thermal conductive and electrical insulation blocks for contacting the sample pallet.

An embodiment of the disclosure provides an electrically assisted annealing apparatus including a sealed cavity, a heater and the aforementioned sample holder for annealing apparatus disposed in the sealed cavity, and a first data extractor, a second data extractor, a temperature controller, a mechanical pump, a power supplier, a gas flow meter and pressure gauge, and a thermocouple external female connector disposed outside the sealed cavity. The sample holder for annealing apparatus is disposed on the heater. The first data extractor extracts a temperature of a sample pallet. The second data extractor extracts a temperature of the heater. The temperature controller adjusts a power supplied to the heater according to the temperature of the sample pallet extracted by the first data extractor. The power supplier supplies a current to the sample pallet. The gas flow meter and pressure gauge controls a gas inlet to the sealed cavity. The thermocouple external female connector is connected to the thermocouple of the sample holder for annealing apparatus and the first data extractor and the temperature controller.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
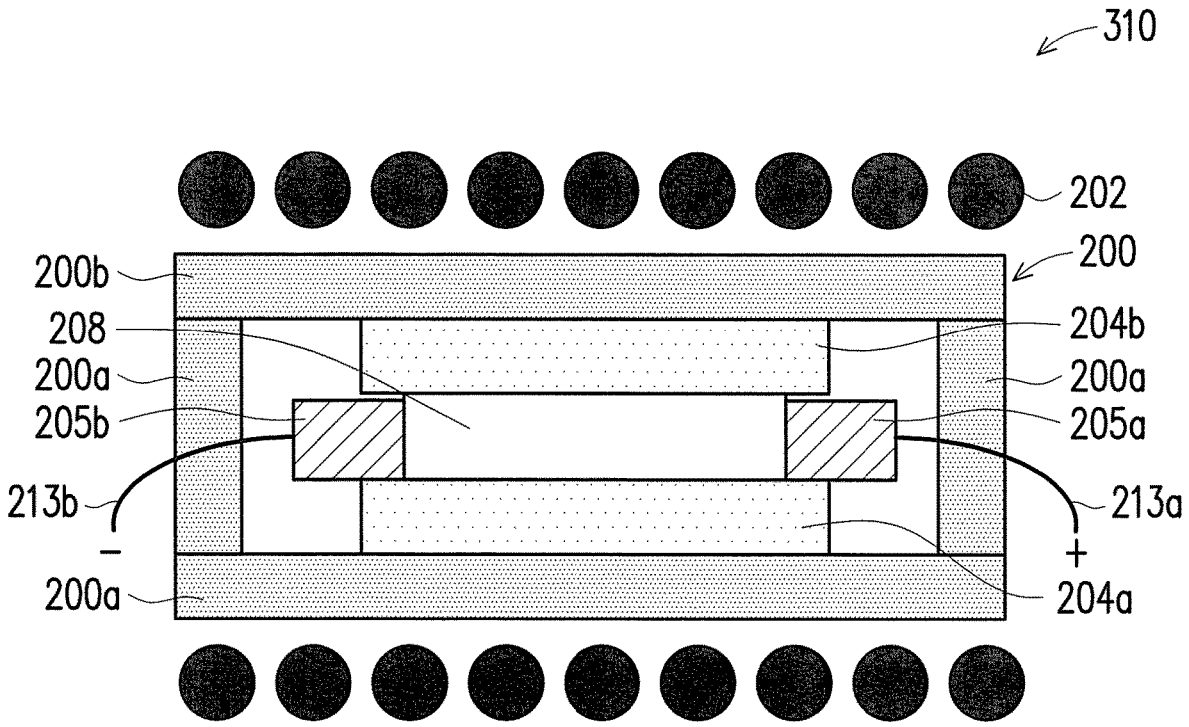
FIG. 1 is a schematic diagram of a sample holder according to the disclosure.

FIG. 1 is a schematic diagram of a sample holder for annealing apparatus according to the disclosure.

Referring to FIG. 1, the sample holder 310 for annealing apparatus of the disclosure includes a heat conductive shell 200, high thermal conductive and electrical insulation blocks 204*a* and 204*b*, a first electrode 205*a* and a second electrode 205*b*.

Referring to FIG. 1, the heat conductive shell 200 includes a base frame 200*a* and a top cover 200*b*. The base frame 200*a* and the top cover 200*b* are assembled to form a space. The high thermal conductive and electrical insulation blocks 204*a* and 204*b* are respectively disposed adjacent to the top of the base frame 200*a* and the bottom of the top cover 200*b*. A sample pallet 208 is sandwiched between the high thermal conductive and electrical insulation blocks 204*a* and 204*b*. The first electrode 205*a* and the second electrode 205*b* are fixed at two sides of the sample pallet 208 and contact the sample pallet 208. The first electrode 205*a* and the second electrode 205*b* are respectively connected to electrifying wires 213*a* and 213*b*. A heating device 202 can be installed outside the heat conductive shell 200 of the sample holder 310 for annealing apparatus of the disclosure to serve as a heat source for regulating an annealing temperature. The heating device 202 can be a contact type conduction resistance heating device, a non-contact type radiation heating device or a sensing heating device, etc.

Figure 2A:
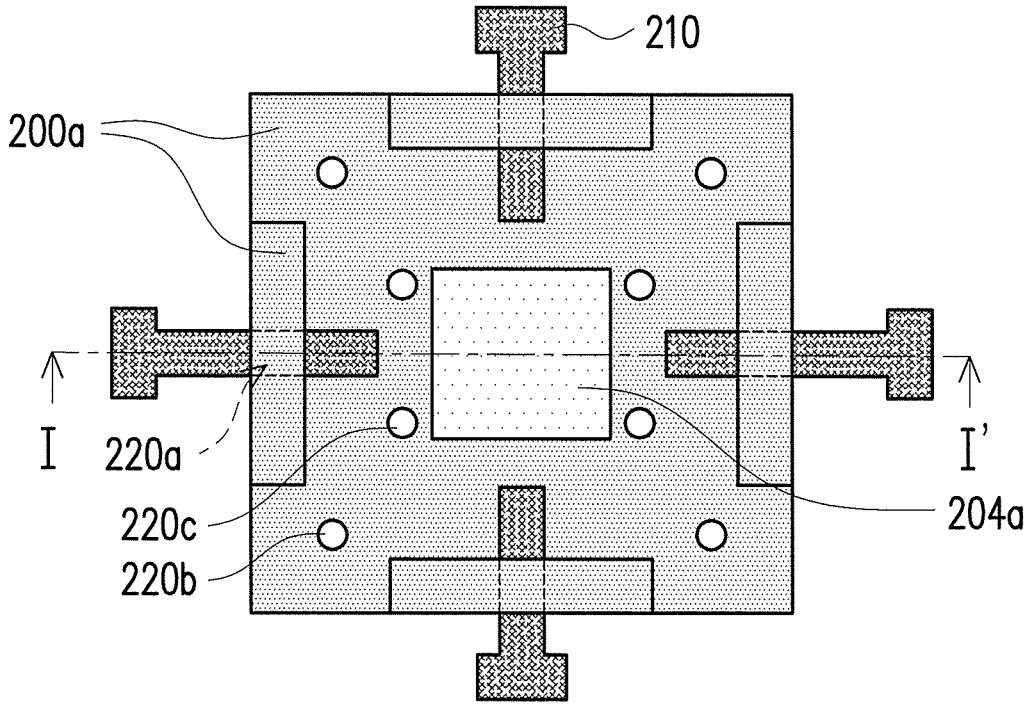
FIG. 2A is a top view of a base frame according to an embodiment of the disclosure.
Figure 2B:
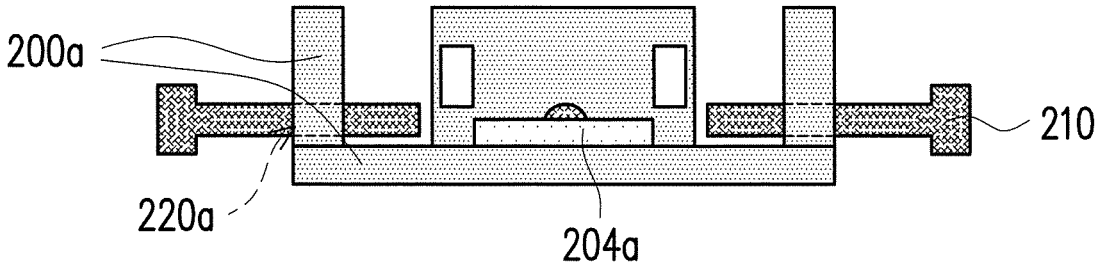
FIG. 2B is a side view of FIG. 2A along a line I-I'.
Figure 2C:
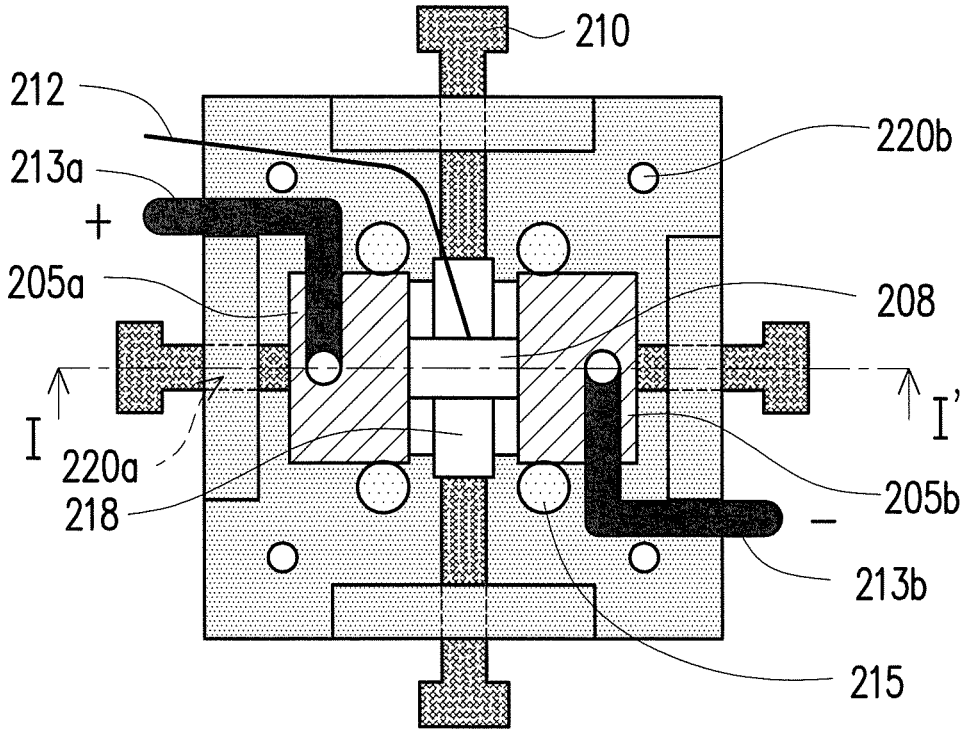
FIG. 2C is a top view of a sample holder without a top cover according to an embodiment of the disclosure.
Figure 2D:
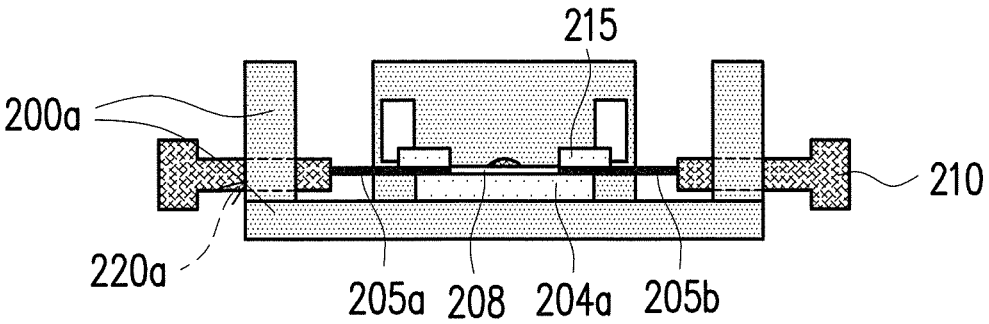
FIG. 2D is a side view of FIG. 2C along a line I-I'.

FIG. 2A is a top view of the base frame according to an embodiment of the disclosure. FIG. 2B is a cross-sectional view of the base frame according to an embodiment of the disclosure. FIG. 2C is a top view of the sample holder without the top cover according to an embodiment of the disclosure. FIG. 2D is a cross-sectional view of the sample holder without the top cover according to an embodiment of the disclosure.

Referring to FIG. 1, FIG. 2A and FIG. 2B, the heat conductive shell 200 includes the base frame 200*a* and the top cover 200*b*. The base frame 200*a* and the top cover 200*b* can be assembled to form a space. A material of the base frame 200*a* of the heat conductive shell 200 can be metal, alloy or a combination thereof, for example, copper, aluminium, etc., alloy or metal-based composite materials that have a high thermal conductivity. In an embodiment of the disclosure, the material of the heat conductive shell 200 is copper. A bottom surface of the base frame 200*a* may have any shape including square, rectangle, polygon or circle. In an embodiment of the disclosure, the bottom surface of the base frame 200*a* is a square. In an embodiment, the base frame 200*a* is made of a copper block, and sidewalls of the base frame 200*a* have holes 220*a*, and the bottom surface has lateral holes 220*b* and medial holes 220*c*.

Referring to FIG. 1, FIG. 2A and FIG. 2B, the high thermal conductive and electrical insulation block 204*a* is disposed on the top of the base frame 200*a*. Thermal conductivity of the high thermal conductive and electrical insulation block 204*a* is between 30 W/mK and 180 W/mK. The high thermal conductive and electrical insulation block 204*a* can be made of a ceramic material, metal with a surface treated with isolation treatment, alloy with a surface treated with isolation treatment or a combination thereof. The ceramic material is, for example, boron nitride (BN), aluminium nitride (AlN), beryllium oxide (BeO) or a combination thereof. The metal is, for example, copper or aluminium. In an embodiment of the disclosure, the high thermal conductive and electrical insulation block 204*a* is made of BN. The sample pallet 208 can be sandwiched between the high thermal conductive and electrical insulation blocks 204*a* and 204*b*, where a length and a width of each of the high thermal conductive and electrical insulation blocks 204*a* and 204*b* are greater than a length and a width of the sample pallet 208, i.e. an area of each of the high thermal conductive and electrical insulation blocks 204*a* and 204*b* is greater than an area of the sample pallet 208, and the high thermal conductive and electrical insulation blocks 204*a* and 204*b* can cover the sample pallet 208.

Referring to FIG. 1, FIG. 2C and FIG. 2D, the first electrode 205*a* and the second electrode 205*b* are fixed at two sides of the sample pallet 208 and contact the sample pallet 208. A thickness of each of the first electrode 205*a* and the second electrode 205*b* is smaller than a thickness of the sample pallet 208, and a width of each of the first electrode 205*a* and the second electrode 205*b* is greater than a width of the sample pallet 208, such that the sample pallet 208 can entirely and closely contact the high thermal conductive and electrical insulation blocks 204*a* and 204*b*. A material of the first electrode 205*a* and the second electrode 205*b* includes metal or alloy, for example, gold, silver, copper, nickel or an alloy thereof. In an embodiment of the disclosure, a material of the first electrode 205*a* and the second electrode 205*b* is nickel.

Referring to FIG. 1, FIG. 2A to FIG. 2D, the sample holder 310 for annealing apparatus includes the heat conductive shell 200, the high thermal conductive and electrical insulation blocks 204*a* and 204*b*, the first electrode 205*a* and the second electrode 205*b*, and further includes fixing screws 210. The fixing screws 210 can penetrate through the holes 220*a* of the base frame 200*a* from the outside to tightly press the first electrode 205*a* and the second electrode 205*b* against the two sides of the sample pallet 208. The fixing screws 210 are, for example, ceramic screws or plastic screws. A material of the fixing screw 210 is, for example, zirconium oxide ($ZrO_2$), aluminium oxide ($Al_2O_3$), polyetheretherketone (PEEK) or polybenzimidazole (PBI). At the inner side of the base frame 200*a*, heat-resistant screws 215 can be used to penetrate through the holes 220*c* of the base frame 200*a* to tightly press against the first electrode 205*a* and the second electrode 205*b*, so as to prevent warping of the first electrode 205*a* and the second electrode 205*b*. The heat-resistant screws 215 are, for example, PBI isolation heat-resistant screws, $ZrO_2$ or $Al_2O_3$ heat-resistant screws or PEEK heat-resistant screws. The first electrode 205*a* and the second electrode 205*b* contact the sample pallet 208, and are respectively connected to electrifying wires 213*a* and 213*b*. In the present embodiment, screws are used to fix various components, though the disclosure is not limited thereto, and in other embodiments, springs or leaf springs can also be used.

Referring to FIG. 2C and FIG. 2D, the sample holder 310 for annealing apparatus may further include fixing sheets 218. The fixing sheets 218 are respectively disposed between the sample pallet 208 and the first electrode 205*a* and between the sample pallet 208 and the second electrode 205*b*, and are fixed through the fixing screws 210 from external. The fixing sheets 218 can be made of an insulation material, for example, a ceramic material, glass, $ZrO_2$, $Al_2O_3$ or a combination thereof.

Referring to FIG. 2C and FIG. 2D, a thermocouple 212 can be further configured to any side of the sample pallet 208. The thermocouple 212 is sandwiched between the sample pallet 208 and the fixing sheet 218, and is fixed through the fixing sheet 218 and the fixing screw 210, such that the thermocouple 212 completely contacts the sample pallet 208 to measure an actual annealing temperature of the sample pallet 208.

Moreover, the first electrode 205*a* and the second electrode 205*b* are respectively connected to the electrifying wires 213*a* and 213*b*, so that a DC current can be inlet to the sample pallet 208. The first electrode 205*a* can be positive or negative, and the second electrode 205*b* can be negative or positive. In an embodiment, the first electrode 205*a* connected to the electrifying wire 213*a* is a positive electrode, and the second electrode 205*b* connected to the electrifying wire 213*b* is a negative electrode.

Figure 2E:
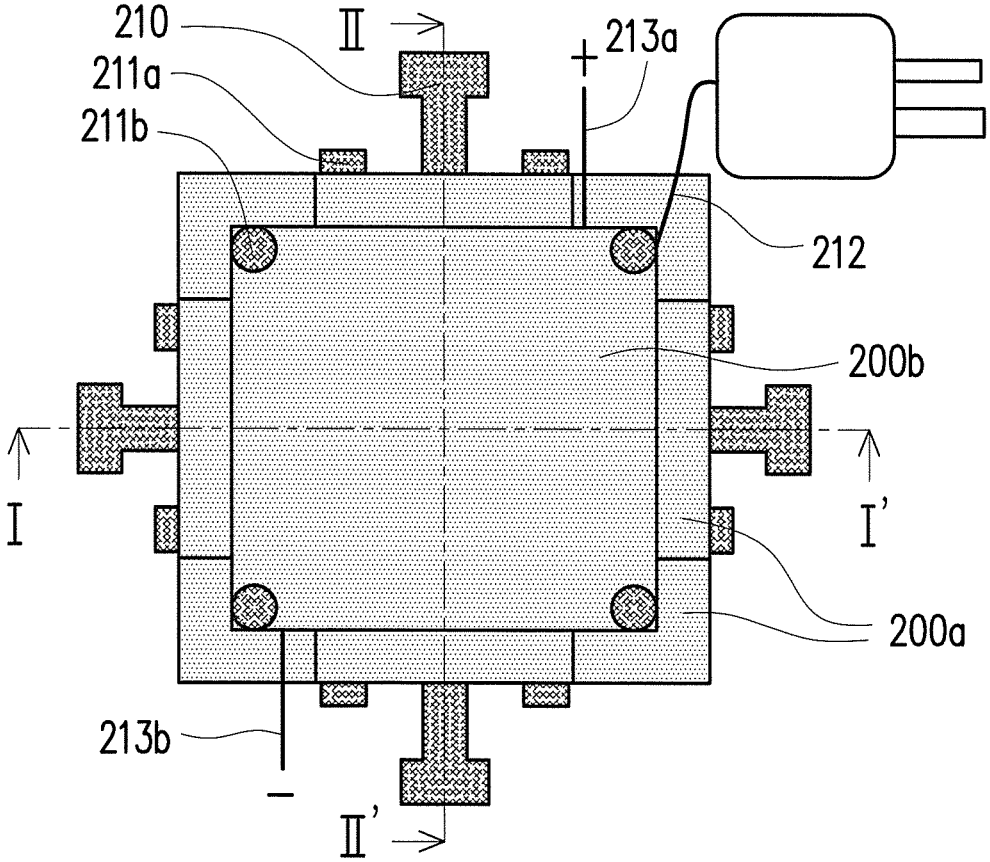
FIG. 2E is a top view of a sample holder according to an embodiment of the disclosure.
Figure 2F:
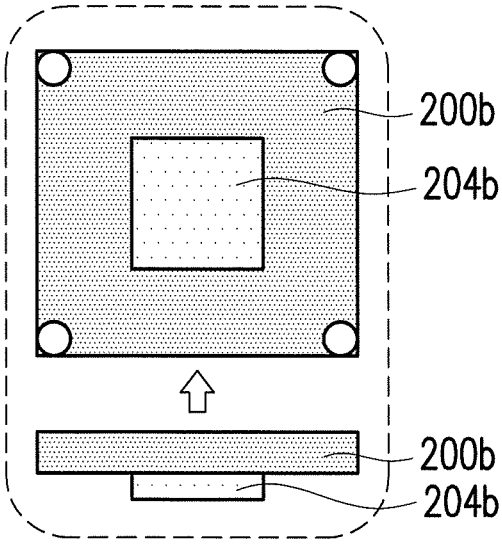
FIG. 2F is a schematic diagram of a top cover according to an embodiment of the disclosure.
Figure 2G:
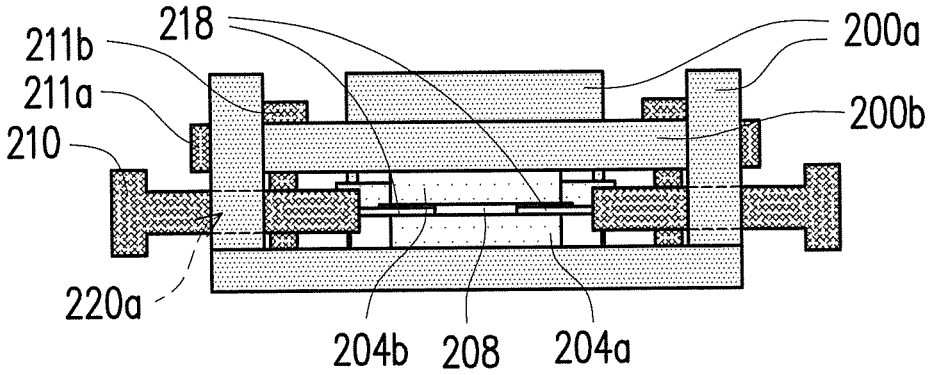
FIG. 2G is a side view of FIG. 2E along a line I-I'.
Figure 2H:
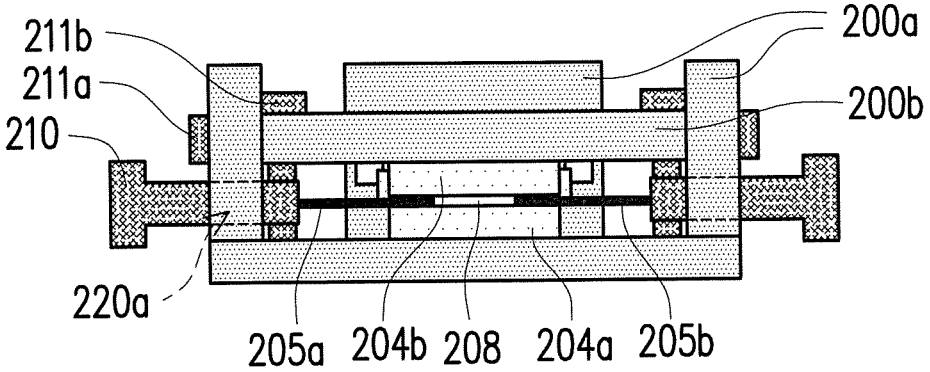
FIG. 2H is a side view of FIG. 2E along a line II-II'.

FIG. 2E is a top view of a sample holder according to an embodiment of the disclosure. FIG. 2F is a schematic diagram of a top cover according to an embodiment of the disclosure. FIG. 2G is a cross-sectional view of FIG. 2E along a line I-I'. FIG. 2H is a cross-sectional view of FIG. 2E along a line II-II'.

Referring to FIG. 2E to FIG. 2H, the top cover 200*b* can be fixed to the base frame 200*a* through fixing screws 211*a* and 211*b*. The fixing screws 211*a* and 211*b* are not necessarily to be made of insulation materials, for example, can be metal screws. The top cover 200*b* of the heat conductive shell 200 may have any shape including square, rectangle, polygon or circle. In an embodiment of the disclosure, the top cover 200*b* is a square. The high thermal conductive and electrical insulation block 204*b* is disposed under the top cover 200*b*. When the fixing screw 211*b* is tightened, the high thermal conductive and electrical insulation block 204*b* and the sample pallet 208 are closely attached. The thermal conductivity of the high thermal conductive and electrical insulation block 204*b* is between 30 W/mK to 200 W/mK. The material of the high thermal conductive and electrical insulation block 204*b* can be the same of different to the material of the high thermal conductive and electrical insulation block 204*a*. The high thermal conductive and electrical insulation block 204*b* includes a ceramic material, metal with a surface treated with isolation treatment, alloy with a surface treated with isolation treatment or a combination thereof. The ceramic material is, for example, boron nitride (BN), aluminium nitride (AlN), beryllium oxide (BeO) or a combination thereof. The metal is, for example, copper or aluminium. In an embodiment of the disclosure, the high thermal conductive and electrical insulation block 204*b* is made of BN. The sample pallet 208 can be sandwiched between the high thermal conductive and electrical insulation blocks 204*a* and 204*b*, where the length and the width of each of the high thermal conductive and electrical insulation blocks 204*a* and 204*b* are greater than the length and the width of the sample pallet 208, i.e. the area of each of the high thermal conductive and electrical insulation blocks 204*a* and 204*b* is greater than the area of the sample pallet 208, and the high thermal conductive and electrical insulation blocks 204*a* and 204*b* can cover the sample pallet 208.

Referring to FIG. 2A and FIG. 2B, before the test is performed, the high thermal conductive and electrical insulation block 204*a* has been disposed on the base frame 200*a*. The fixing screws 210 are disposed on the base frame 200*a* through the holes 220*a*.

Referring to FIG. 2C and FIG. 2D, the sample pallet 208 can be disposed on the high thermal conductive and electrical insulation block 204*a* on the base frame 200*a* (FIG. 2A and FIG. 2B). By tightening the fixing screws 210, the first electrode 205*a* and the second electrode 205*b* are tightly pressed against the two sides of the sample pallet 208. At the inner side of the base frame 200*a*, the heat-resistant screws 215 can be used to penetrate through the holes 220*c* of the base frame 200*a* to tightly press against the first electrode 205*a* and the second electrode 205*b*, so as to prevent warping of the first electrode 205*a* and the second electrode 205*b*. The fixing sheets 218 are respectively disposed between the sample pallet 208 and the first electrode 205*a* and between the sample pallet 208 and the second electrode 205*b*, and are fixed through the fixing screws 210 from external. The thermocouple 212 is sandwiched between the sample pallet 208 and the fixing sheet 218, and is fixed through the fixing sheet 218 and the fixing screw 210, such that the thermocouple 212 completely contacts the sample pallet 208.

Referring to FIG. 2E and FIG. 2F, the top cover 200*b* can be fixed to the base frame 200*a* through the fixing screws 211*a* and 211*b*. When the fixing screw 211*b* is tightened, the high thermal conductive and electrical insulation block 204*b* can tightly press the sample pallet 208.

When the test is performed, a heating source can be provided at periphery of the heat conductive shell 200 for annealing treatment. Since the high thermal conductive and electrical insulation blocks 204*a* and 204*b* are made of a material with high thermal conductivity, in the annealing treatment, if a temperature of the sample pallet 208 is lower than a preset annealing temperature, the heat provided at periphery of the heat conductive shell 200 can be conducted to the sample pallet 208 through the high thermal conductive and electrical insulation blocks 204*a* and 204*b* to increase the temperature of the sample pallet 208. If the temperature of the sample pallet 208 is higher than the preset annealing temperature, the excessive heat can be conducted from the sample pallet 208 to the heat conductive shell 200 through the high thermal conductive and electrical insulation blocks 204*a* and 204*b* to decrease the temperature of the sample pallet 208. In this way, the annealing temperature can be effectively controlled. The actual annealing temperature of the sample pallet 208 can be measured through the thermocouple 212. The electrifying wires 213*a* and 213*b* can be used to provide currents of different values to the sample pallet 208. Therefore, the sample holder 310 for annealing apparatus of the disclosure can simultaneously set a current magnitude and the annealing temperature.

Figure 3A:
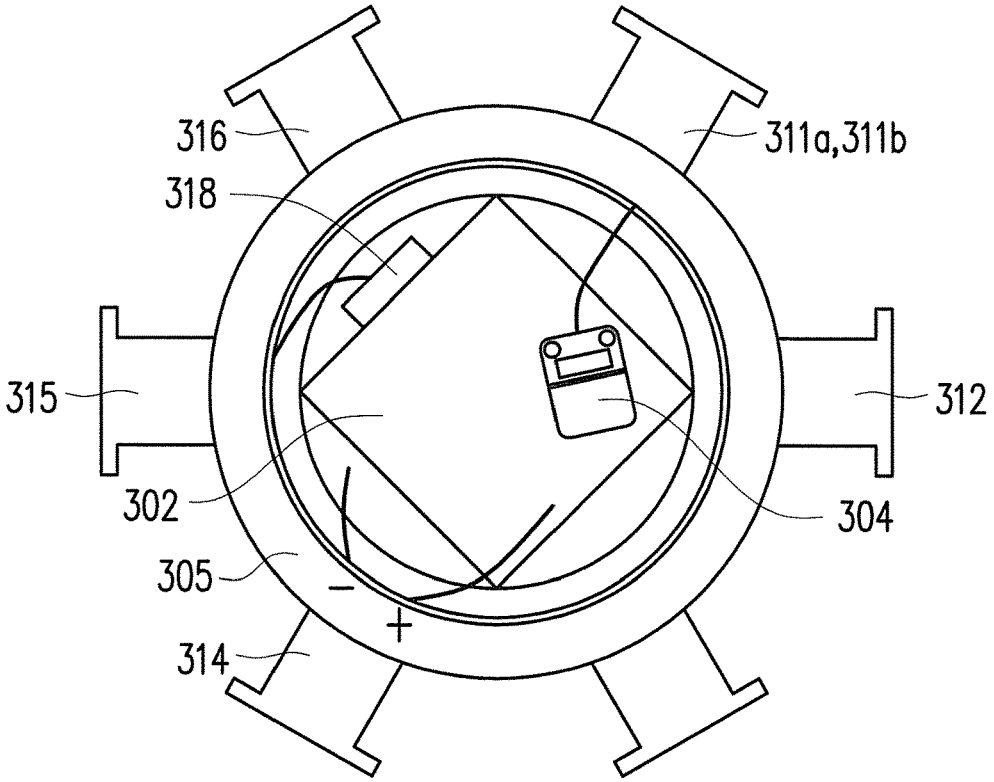
FIG. 3A and FIG. 3B are schematic diagrams of an electrically assisted annealing apparatus according to an embodiment of the disclosure.
Figure 3B:
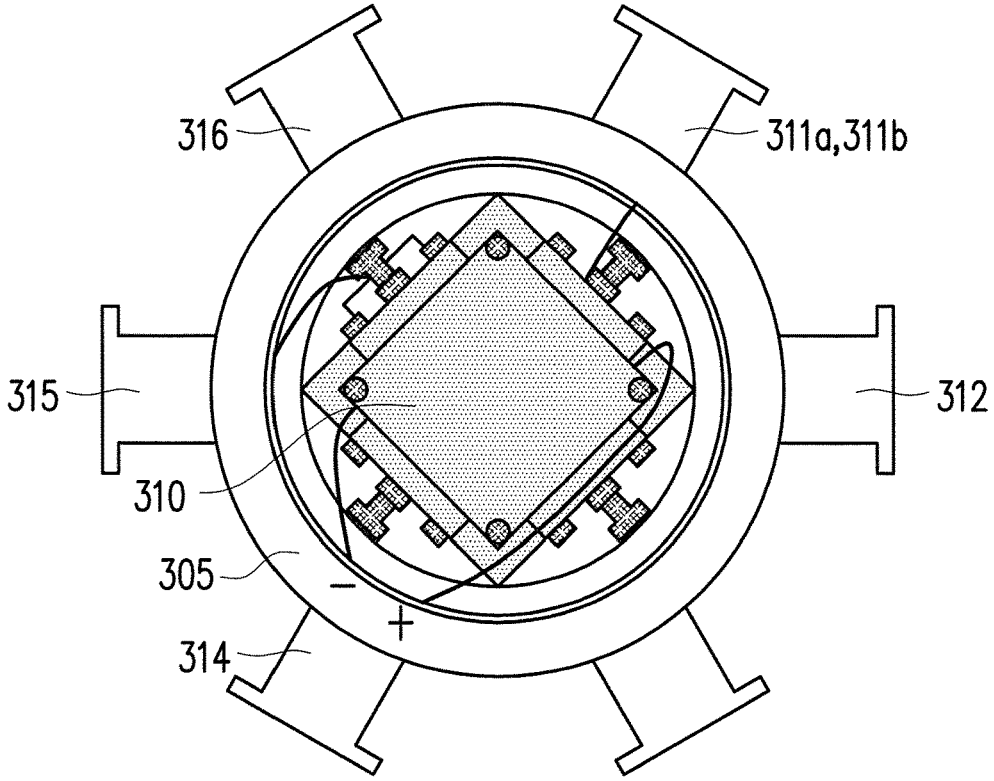

FIG. 3A and FIG. 3B are schematic diagrams of an electrically assisted annealing apparatus according to an embodiment of the disclosure.

Referring to FIG. 3A, a heater 302 and a thermocouple external female connector 304 are configured in a sealed cavity 305, and the heater 302 is connected to a heater thermocouple 318.

Referring to FIG. 3A and FIG. 3B, a plurality of functional parts are configured outside the sealed cavity 305, which include a first data extractor 311*a* and a temperature controller 311*b*, a mechanical pump 312, a power supplier 314, a second data extractor 315, a gas flow meter and pressure gauge 316. The aforementioned sample holder 310 of the disclosure can be disposed on the heater 302. The thermocouple 212 (shown in FIG. 2C) of the sample holder 310 is connected to the thermocouple external female connector 304. The electrifying wires 213*a* and 213*b* (shown in FIG. 1 and FIG. 2C) of the sample holder 310 are connected to the power supplier 314. The first data extractor 311*a* and the temperature controller 311*b* are all connected to the thermocouple external female connector 304 for measuring and extracting the temperature of the sample pallet 208 (shown in FIG. 2C). The temperature controller 311*b* is, for example, a proportional-integral-derivative controller (PID controller), which is used for adjusting a power supplied to the heater 302 so that the heater 302 can conduct heating. The mechanical pump 312 maintains a vacuum state of the sealed cavity 305. The power supplier 314 can be a DC power supplier, which is adapted to inlet a DC current to the sample pallet 208 in the sample holder 310 (FIG. 2C), and set a magnitude of the current inlet to the sample holder 310. The second data extractor 315 is connected to the heater thermocouple 318, and displays and records a temperature of the heater 302. The gas flow meter and pressure gauge 316 controls a gas inlet to the sealed cavity 305, and the gas inlet to the sealed cavity 305 includes nitrogen or inert gas.

Figure 4:
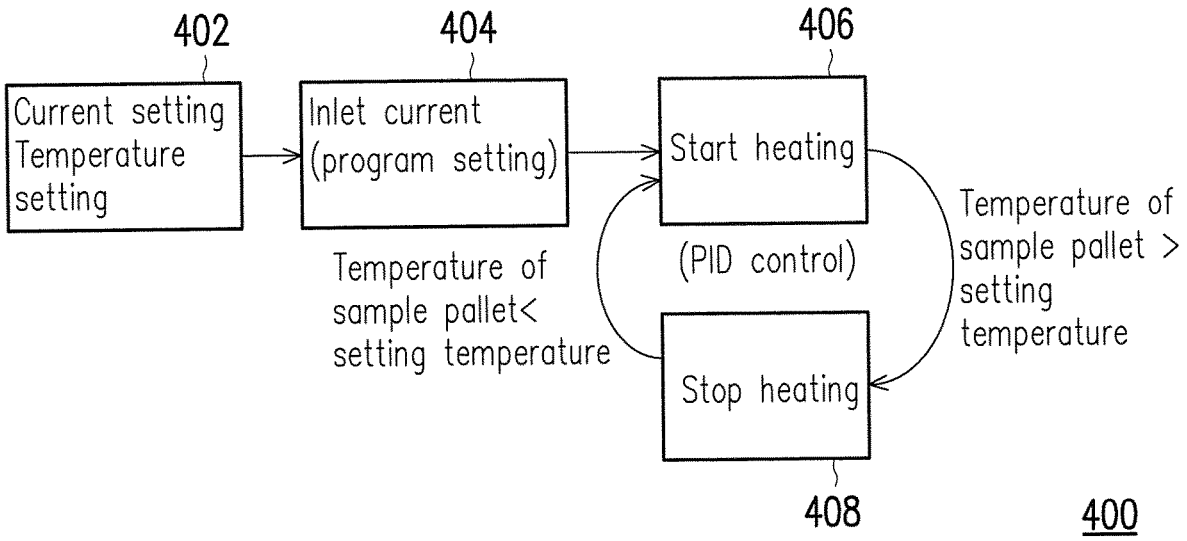
FIG. 4 is a control flowchart of the electrically assisted annealing apparatus of the disclosure.

FIG. 4 is a control flowchart of the electrically assisted annealing apparatus of the disclosure.

Referring to FIG. 4, in step 402, a current magnitude and an annealing temperature of the electrically assisted annealing apparatus of the disclosure are simultaneously set. In step 404, a preset current is inlet to the sample pallet. In step 406, the sample pallet is heated to perform annealing treatment. When the annealing treatment is performed, different functional parts (for example, data extractors, a temperature controller, a mechanical pump, a power supplier, a gas flow meter and pressure gauge) are used to monitor a state in the electrically assisted annealing apparatus, and a PID controller is used to control a heating power of a heater. When the temperature of the sample pallet is higher than a setting temperature, a step 408 is executed to stop heating, and the sample pallet is cooled down through the high thermal conductive and electrical insulation blocks in the sample holder 310 (shown in FIG. 3B) of the disclosure. When the temperature of the sample pallet is lower than the setting temperature, a step 406 is executed again to start heating, and the heat provided by the heater is conducted to the sample pallet through the high thermal conductive and electrical insulation blocks to increase the temperature of the sample pallet. In this way, a good and stable annealing condition is maintained.

Example 1

Figure 5:
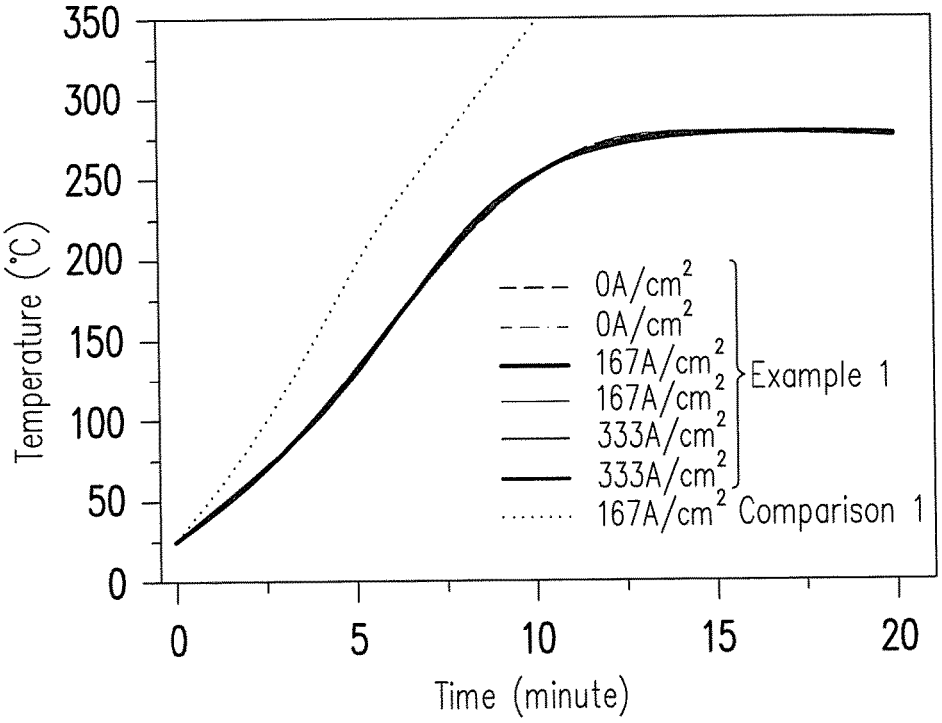
FIG. 5 illustrates temperature variations of sample pallets of an example 1 and a comparison 1 under different current densities.

The sample holder having the BN high thermal conductive and electrical insulation blocks of the disclosure is used to test a temperature variation of a Bi—Sb—Te sample pallet under different current densities (0 A/cm$^2$, 167 A/cm$^2$, 333 A/cm$^2$), and a result thereof is shown in FIG. 5.

Comparison 1

The sample holder without the BN high thermal conductive and electrical insulation blocks is used to test a temperature variation of a Bi—Sb—Te sample pallet under a current density of 167 A/cm$^2$, and a result thereof is shown in FIG. 5.

According to the result of FIG. 5, when the inlet current density of the sample pallet of the example 1 (sandwiched between the high thermal conductive and electrical insulation blocks) is 0 A/cm$^2$, 167 A/cm$^2$, 333 A/cm$^2$, a same temperature increasing curve is obtained, and the temperature control is good. When the inlet current density of the sample pallet of the comparison 1 (not sandwiched between the high thermal conductive and electrical insulation blocks) is 167 A/cm$^2$, the temperature is increased along a straight line without control, and a specific annealing temperature cannot be maintained. According to the above result, by using the BN high thermal conductive and electrical insulation blocks, the annealing temperature can be effectively controlled under high temperature.

Example 2

Figure 6A:
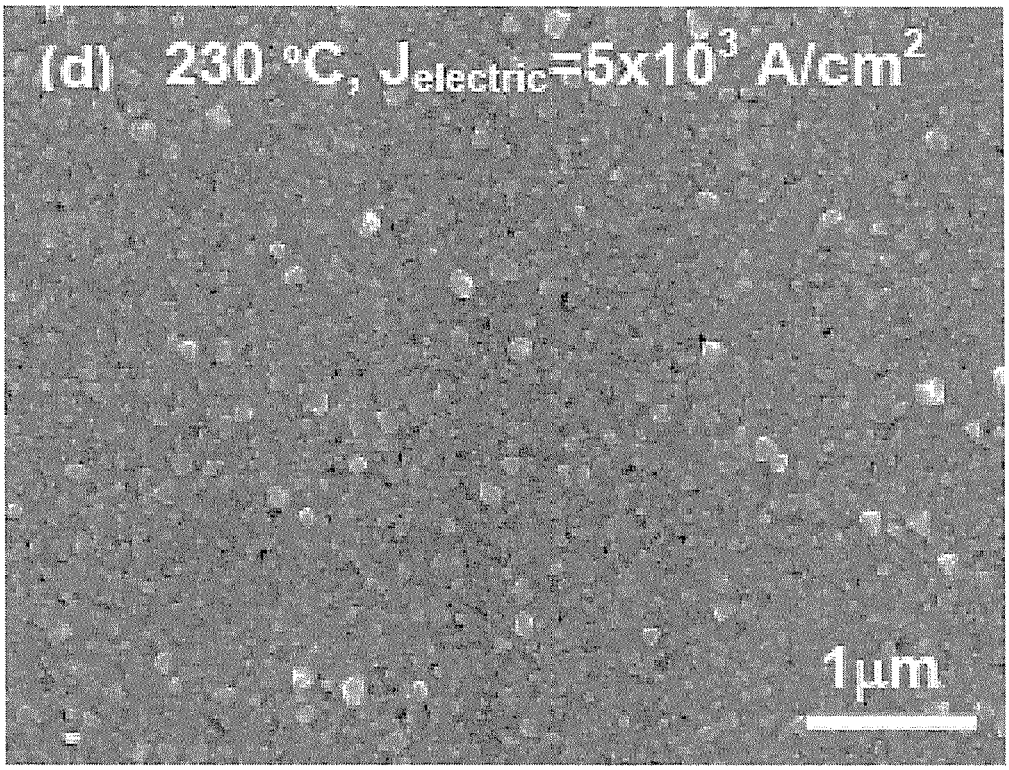
FIG. 6A, FIG. 6B and FIG. 6C are respectively microstructure images of the sample pallet of an example 2 in an electrically assisted annealing treatment under different temperatures (230° C., 270° C., 300° C.).
Figure 6B:
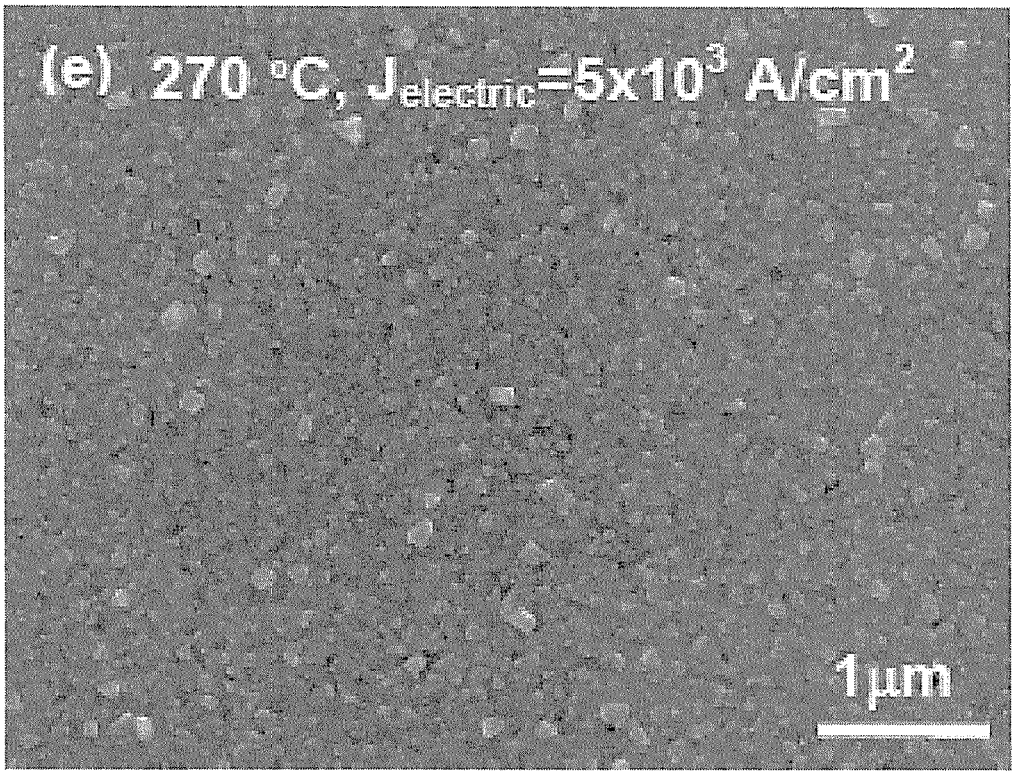
Figure 6C:
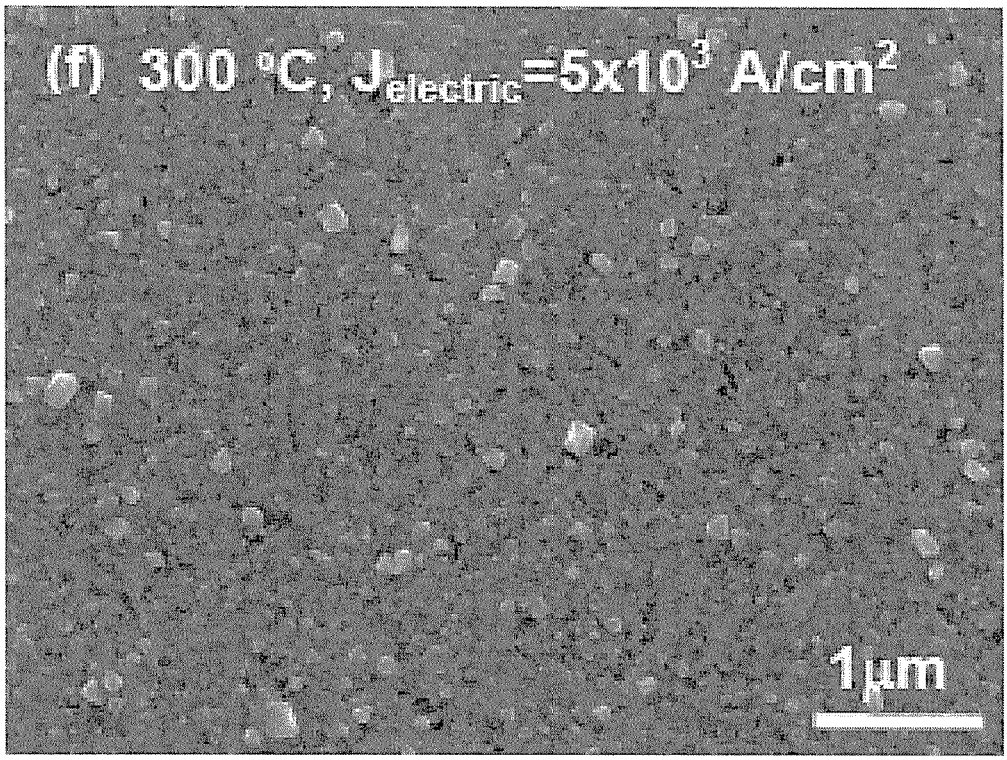

In case of electrically assisted annealing treatment of the Bi—Te—Se sample pallet under a current density of 4000 A/cm$^2$ and different temperatures (230° C., 270° C., 300° C.), the microstructures thereof are as shown in FIG. 6A, FIG. 6B and FIG. 6C.

Comparison 2

Figure 7A:
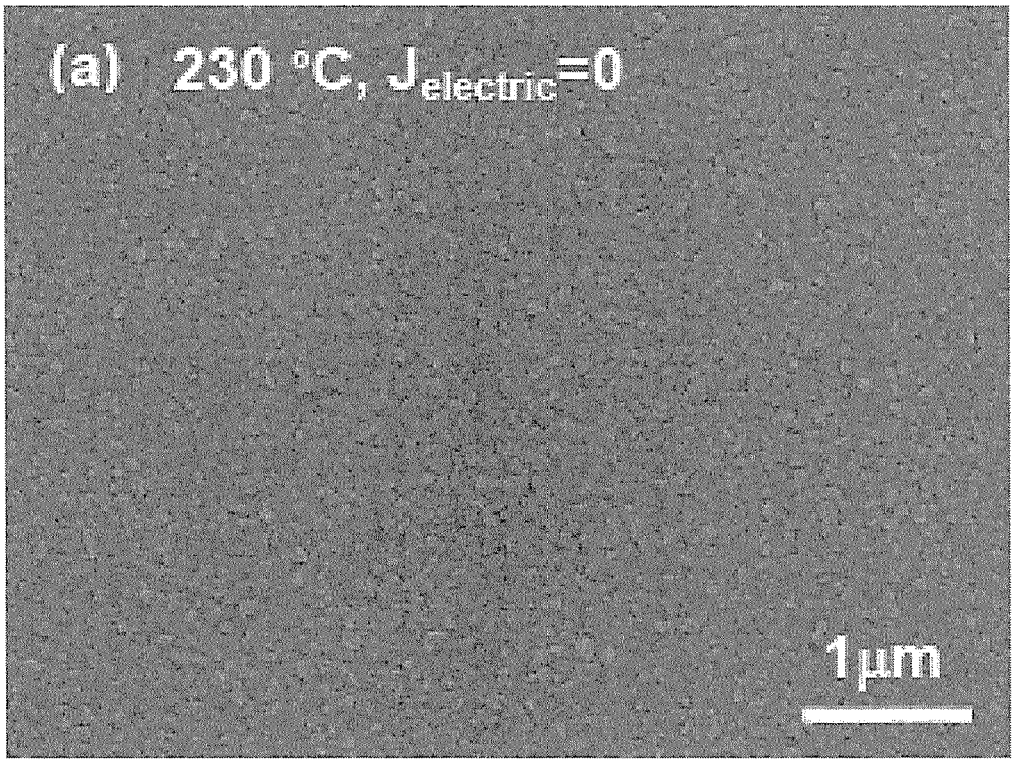
FIG. 7A, FIG. 7B and FIG. 7C are respectively microstructure images of the sample pallet of a comparison 2 in a simple thermal annealing treatment (without electrical assistance) under different temperatures (230° C., 270° C., 300° C.).
Figure 7B:
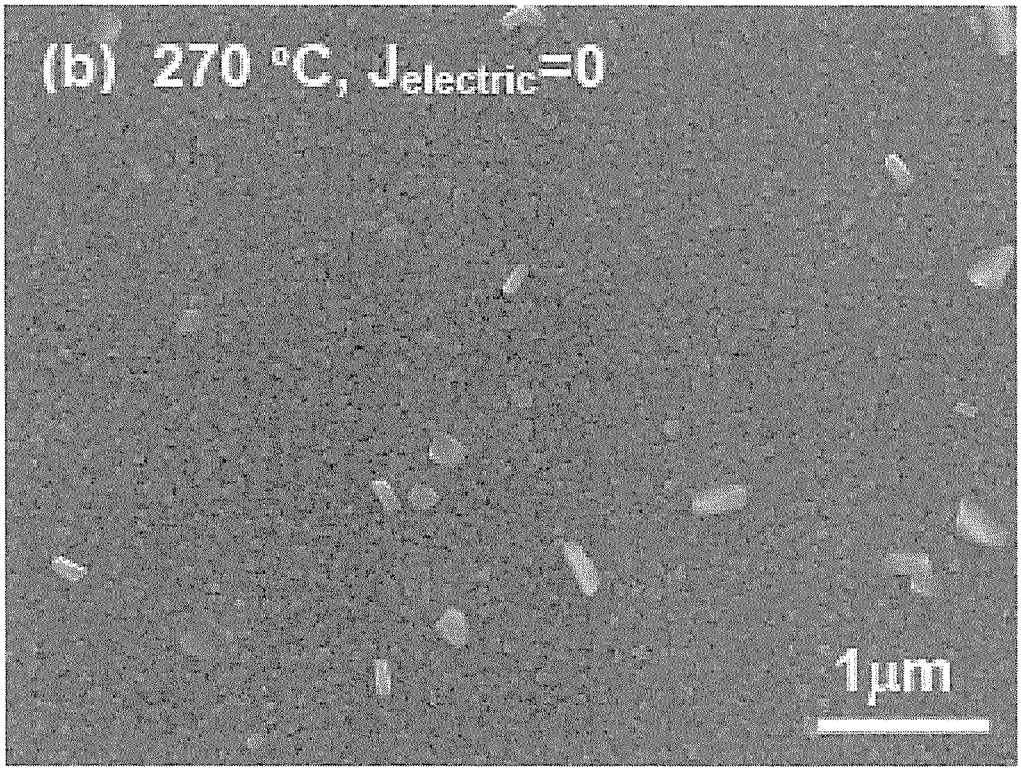
Figure 7C:
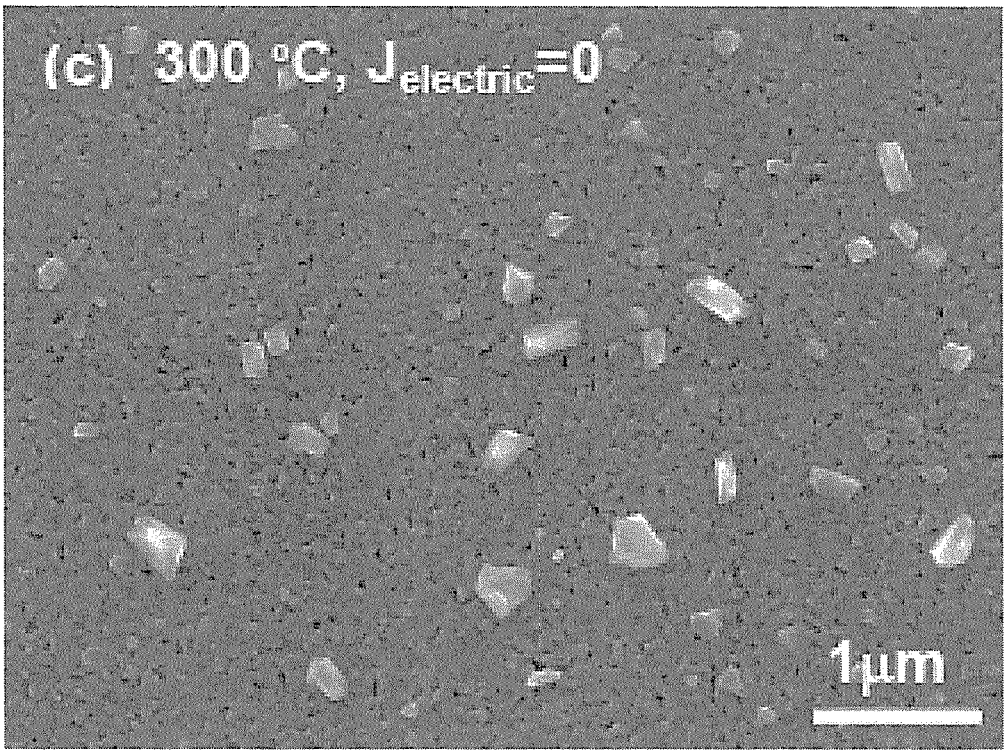

In case of simple thermal annealing treatment (without electrical assistance) of the Bi—Te—Se sample pallet under different temperatures (230° C., 270° C., 300° C.), the microstructures thereof are as shown in FIG. 7A, FIG. 7B and FIG. 7C.

According to FIG. 6A-FIG. 6C and FIG. 7A-FIG. 7C, it is known that regarding the annealing treatment under electrical assistance, a specific nanophase can be precipitated under a lower annealing temperature, and the precipitated phases are fine and even. Comparatively, regarding the simple thermal annealing treatment (without electrical assistance), the nanophase can be precipitated under a high annealing temperature, and the precipitated phases are irregular and rough. According to the above result, it is known that the electrically assisted annealing treatment has an effect that cannot be achieved by the simple thermal annealing treatment, by which the material is promoted to precipitate the specific nanophase under a lower annealing temperature, and the precipitated phases are fine and even.

Example 3

Figure 8:
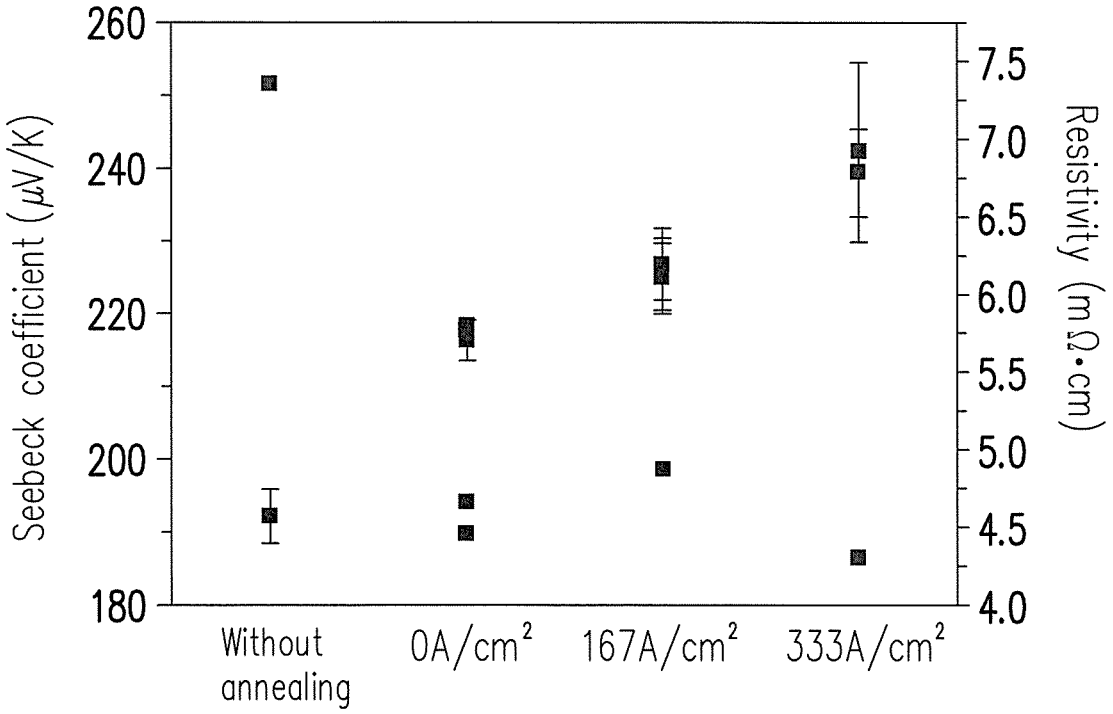
FIG. 8 is a diagram illustrating a relationship of a Seebeck coefficient α and a electrical resistivity ρ of Bi—Te—Se sample pallets of an example 3, an example, 4 and a comparison 3 in case of electrically assisted annealing treatment under 275° C. and a current density of 333 A/cm$^2$, and in case of a simple thermal annealing treatment under 275° C.

In case of electrically assisted annealing treatment of the Bi—Sb—Te sample pallet under a temperature of 275° C. and a current density of 167 A/cm$^2$, a relationship between a Seebeck coefficient $\alpha$ and a electrical resistivity $\rho$ thereof is as shown in FIG. 8, and a thermoelectric characteristic (power factor $P=\alpha^2/\rho$) is as shown in a following table 1.

Example 4

In case of electrically assisted annealing treatment of the Bi—Sb—Te sample pallet under a temperature of 275° C. and a current density of 333 A/cm$^2$, a relationship between the Seebeck coefficient $\alpha$ and the electrical resistivity $\rho$ thereof is as shown in FIG. 8, and a thermoelectric characteristic is as shown in the following table 1.

Comparison 3

In case of a simple thermal annealing treatment of the Bi—Sb—Te sample pallet under a temperature of 275° C. (without electrical assistance, the electrical assistance is 0 A/cm$^2$), a relationship between the Seebeck coefficient $\alpha$ and the electrical resistivity $\rho$ thereof is as shown in FIG. 8, and a thermoelectric characteristic is as shown in a following table 1.

TABLE 1

| Annealing condition | Power factor($10^{-9}$ W/K$^2$cm) |
|---|---|
| Without annealing | 4981.5 |
| Comparison 3 | 10004.1 |
| Example 3 | 10442.2 |
| Example 4 | 13394.3 |

According to the table 1 and FIG. 8, the Seebeck coefficient $\alpha$ is increased along with increase of the annealing current density, and the electrical resistivity ρ is decreased along with increase of the annealing current density. According to the above result, by using the apparatus of the disclosure to perform the electrically assisted annealing treatment, an effect of improving the thermoelectric characteristic of the material is achieved.

In summary, the sample holder for annealing apparatus of the disclosure and the electrically assisted annealing apparatus using the same can control and stabilize a temperature and a current of the annealing treatment. The sample holder for annealing apparatus of the disclosure and the electrically assisted annealing apparatus using the same can promote the material to precipitate the specific nanophase under a lower annealing temperature, and the precipitated phases are fine and even. The sample holder for annealing apparatus of the disclosure and the electrically assisted annealing apparatus using the same can improve the thermoelectric characteristic of the material after the annealing treatment. The sample holder for annealing apparatus of the disclosure and the electrically assisted annealing apparatus using the same can satisfy requirements on consistency of annealing treatment parameters, reproductivity of material microstructures and characteristics, and optimal control of the material microstructures.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A sample holder for annealing apparatus, comprising:

a heat conductive shell, comprising a base frame and a top cover, wherein the base frame comprises a bottom surface and a plurality of sidewalls, and the plurality of sidewalls extends from each side of a periphery of the bottom surface to contact the top cover and define an enclosed space;

a plurality of high thermal conductive and electrical insulation blocks, respectively disposed adjacent to the top of the base frame and the bottom of the top cover within the enclosed space, wherein a sample pallet is sandwiched between the high thermal conductive and electrical insulation blocks; and a first electrode and a second electrode, disposed opposite to each other between the high thermal conductive and electrical insulation blocks for contacting the sample pallet, wherein the first and second electrodes are at lateral sides of the sample pallet and electrically connected with the sample pallet.

2. The sample holder for annealing apparatus as claimed in claim 1, wherein a material of the high thermal conductive and electrical insulation blocks comprises a ceramic material, metal with a surface treated with isolation treatment, alloy with a surface treated with isolation treatment or a combination thereof.

3. The sample holder for annealing apparatus as claimed in claim 2, wherein a material of the high thermal conductive and electrical insulation blocks comprises boron nitride (BN), aluminium nitride (AlN), beryllium oxide (BeO) or a combination thereof.

4. The sample holder for annealing apparatus as claimed in claim 1, wherein the heat conductive shell comprises metal or alloy.

5. The sample holder for annealing apparatus as claimed in claim 4, wherein a material of the heat conductive shell comprises copper, aluminium, alloy or metal-based composite materials that have a high thermal conductivity.

6. The sample holder for annealing apparatus as claimed in claim 1, wherein a material of the first electrode and the second electrode comprises metal or alloy.

7. The sample holder for annealing apparatus as claimed in claim 6, wherein a material of the first electrode and the second electrode comprises gold, silver, copper, nickel or an alloy thereof.

8. The sample holder for annealing apparatus as claimed in claim 1, further comprising a plurality of fixing sheets located at two sides of the sample pallet, wherein the fixing sheets comprise an insulation material.

9. The sample holder for annealing apparatus as claimed in claim 8, a material of the fixing sheets comprises a ceramic material, glass, aluminium oxide or a combination thereof.

10. The sample holder for annealing apparatus as claimed in claim 1, further comprising a thermocouple connected to the sample pallet.

11. The sample holder for annealing apparatus as claimed in claim 1, wherein components are fixed by using screws, springs or leaf springs.

12. The sample holder for annealing apparatus as claimed in claim 11, wherein components are fixed by using screws.

* * * * *